US006614152B1

(12) United States Patent
Berton et al.

(10) Patent No.: US 6,614,152 B1
(45) Date of Patent: Sep. 2, 2003

(54) FRAME/MASK STRUCTURE FOR CATHODE RAY TUBE

(75) Inventors: Fabrizio Berton, Segni (IT); Pierluigi Testa, Rome (IT); Joseph Arthur Reed, York, PA (US)

(73) Assignee: Videocolor S.p.A., Anagni (IT)

( * ) Notice: Subject to any disclaimer, the term of this patent is extended or adjusted under 35 U.S.C. 154(b) by 250 days.

(21) Appl. No.: 09/705,538

(22) Filed: Nov. 3, 2000

(30) Foreign Application Priority Data

Nov. 5, 1999 (IT) ..... MI99A2324

(51) Int. Cl.[7] ..... H01J 29/80
(52) U.S. Cl. ..... 313/402
(58) Field of Search ..... 313/402, 403, 313/407, 408, 404, 405, 406

(56) References Cited

U.S. PATENT DOCUMENTS 3,454,813 A * 7/1969 Lewinson ..... 313/284
4,318,025 A * 3/1982 Penird et al. ..... 313/404
4,827,179 A * 5/1989 Adler et al. ..... 313/402
5,986,393 A * 11/1999 Nagata et al. ..... 313/407
6,130,501 A * 10/2000 Tong et al. ..... 313/402
6,469,429 B1 * 10/2002 Berton ..... 313/402
6,469,431 B1 * 10/2002 Suzuki et al. ..... 313/407

FOREIGN PATENT DOCUMENTS

JP P2000-77007 A 3/2000 ..... H01J/29/07

* cited by examiner

*Primary Examiner*—Robert H. Kim
*Assistant Examiner*—Jurie Yun
(74) *Attorney, Agent, or Firm*—Joseph S. Tripoli; Joseph J. Laks; Carlos M. Herrera

(57) ABSTRACT

A color cathode ray tube comprises a color selection mask stretched in at least one direction, the mask comprising on its peripheral surface mask vibration damper means in the form of a coupled oscillator of the type comprising a central part attached to the surface of the mask and two wings extending on either side of the central part.

9 Claims, 5 Drawing Sheets

FRAME/MASK STRUCTURE FOR CATHODE RAY TUBE

The present invention relates to a color selection mask structure for color cathode ray tubes. The invention finds its application in any type of tube comprising a color selection mask and is more particularly adapted to a tube having a mask therein held under tension by a frame to which it is secured.

BACKGROUND OF THE INVENTION

Conventional cathode ray tubes comprise a color selection mask situated a precise distance from the inside of the glass front face of the tube, on which front face are deposited grids of red, green and blue luminophores so as to form a screen. An electron gun disposed inside the tube, in its rear part, generates three electron beams directed towards the front face. An electromagnetic deflection device, generally disposed outside the tube and close to the electron gun, has the function of deviating the electron beams so as to make them scan the surface of the panel on which the grids of luminophores are disposed. Under the influence of three electron beams each corresponding to a specified primary color, the grids of luminophores allow the reproduction of images on the screen, the mask enabling each specified beam to illuminate only the luminophore of the corresponding color.

The color selection mask must be disposed and held during the operation of the tube in a precise position inside the tube. The mask holding functions are carried out by virtue of a generally very rigid rectangular metal frame to which the mask is conventionally welded. The frame/mask assembly is mounted in the front face of the tube by virtue of suspension means which are usually welded to the frame and cooperate with pegs inserted into the glass constituting the front face of the tube.

The current trend is toward tubes having flatter front faces, with a tendency towards totally flat front faces. To make tubes including a front face of this kind, requires a technology consisting in the use of a flat mask held under tension in at least one direction. Such structures are described, for example, in U.S. Pat. No. 4,827,179.

Since the color selection mask consists of a metal foil of very small thickness, its tensioning can give rise to unwanted phenomenon of setting the mask into vibration while the tube is operating. Under the influence of shock or outside mechanical vibrations, for example acoustic vibrations due to the loudspeakers of the television set into which the tube is inserted, the mask can start to vibrate at its natural resonant frequency. The vibrations of the mask consequently modify the zone of landing of the electron beams on the screen of the tube. The points of impact of each beam are then shifted with respect to the associated luminophore grid, thus creating a decoloration of the image reproduced on the screen.

The above-cited U.S. Pat. No. 4,827,179 proposes the addition of means for damping the vibration of the mask to a face of the mask. However, the damping devices implemented in this patent have a complicated structure which is difficult to implement. It is therefore desirable to have a cathode ray tube comprising a mask structure with simple and inexpensive damping means.

SUMMARY OF THE INVENTION

A cathode ray tube, according to the present invention, comprises:

a color selection mask in the form of a substantially rectangular metal foil, adapted so as to be fixed under tension to a support frame and mounted inside the front face of the tube, the mask comprising a central zone drilled with orifices and a peripheral zone disposed between the central zone and the edges of the mask, the mask being able to vibrate independently of the support frame; and means for damping mask vibrations which are disposed at the said periphery of the mask so as to damp the vibrations in the mask, the damping means being characterized in that they comprise a resonator in the form of a flexible metal strip of which one part is fixed to a surface of the peripheral zone of the mask with two wings extending on either side of this one, central, part.

BRIEF DESCRIPTION OF THE DRAWINGS

The invention will be better understood with the aid of the following description and of the drawings, in which.

DETAILED DESCRIPTION OF THE PREFERRED EMBODIMENT

Figure 1:
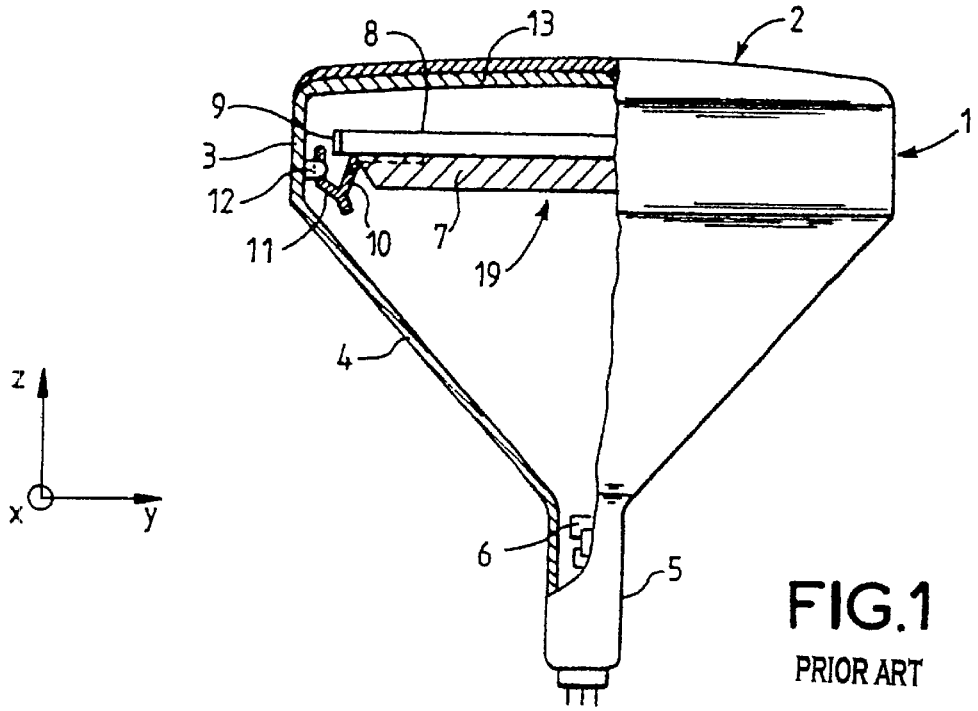
FIG.1 PRIOR ART
FIG. 1 represents a cathode ray tube according to the invention, seen partially cut away.

As illustrated by FIG. 1, a cathode ray tube 1 according to the invention comprises a substantially flat faceplate 2 and a peripheral skirt 3. The faceplate is connected to the rear part of the tube, in the shape of a funnel 4, by virtue of a sintered glass seal. The end part 5 of the tube surrounds the electron gun 6 which emits electron beams that illuminate the luminescent phosphor screen 13 through the color selection mask 8. The mask 8 is flat, for example stretched between the long sides 9 of the frame 19. Metal supports of the frame/mask assembly hold this assembly inside the tube. The supports comprise a part 10 welded to the frame and a part forming a spring 11, provided with an aperture for cooperating with a peg 12 incorporated within the glass skirt 3.

Figure 2:
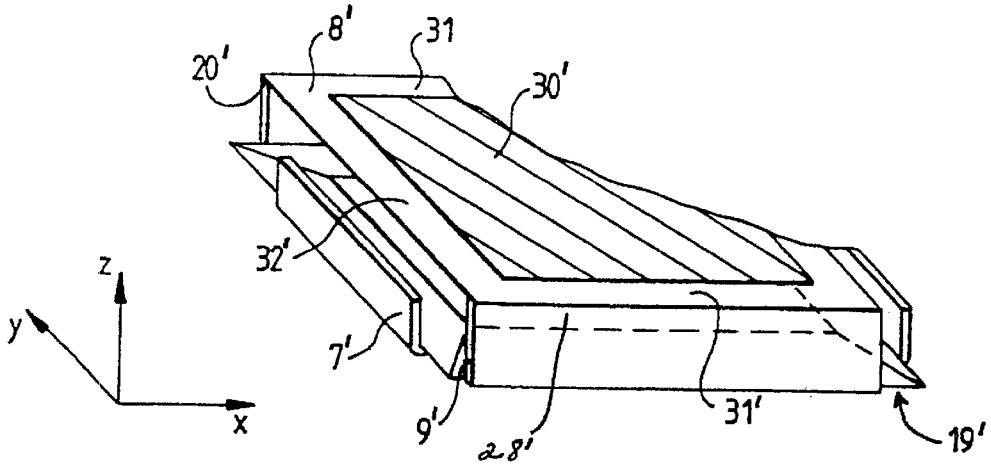
FIG. 2 PRIOR ART
FIG. 2 describes a frame/stretched mask assembly in accordance with the state of the art without a vibration damper.

In the example of the state of the art illustrated by FIG. 2, the frame 19' comprises a pair of long sides 9' and a pair of short sides 7'. The long and short sides have an L cross section. The mask 8', itself of substantially rectangular shape, is tensioned, held in this state, for example, by being welded to the ends 20' of the long sides of the frame.

The mask consists of a metal foil, made for example of steel or Invar, of very small thickness, of the order of 100 $\mu$m. The mask has a central zone 30' with apertures generally disposed in columns and a peripheral zone 28' surrounding the central zone, with horizontal edges 31' and vertical edges 32'.

The structures of cathode ray tubes using tensioned color selection masks have to cope with the problem of the vibration of this mask, in modes which are natural thereto, when the mask is excited by outside vibrations, for example mechanical shocks on the tube or sound vibrations originating from loudspeakers disposed in proximity to the tube. Since these vibrations are manifested by movements of the mask in a direction perpendicular to its surface, the distance between the apertures of the mask and the screen varies locally as a function of the amplitude of the vibration of the mask. The purity of the colors reproduced on the screen is then no longer guaranteed, the points of touchdown of the beams on the screen being shifted as a function of the amplitude of the vibration.

Moreover, since the mask is disposed inside the tube within which a high vacuum prevails, the vibrations of the mask are only very slowly damped, the energy communicated to the mask having few means of dissipation, thus increasing the visibility of the phenomenon on the screen when the tube is operating.

Figure 3:
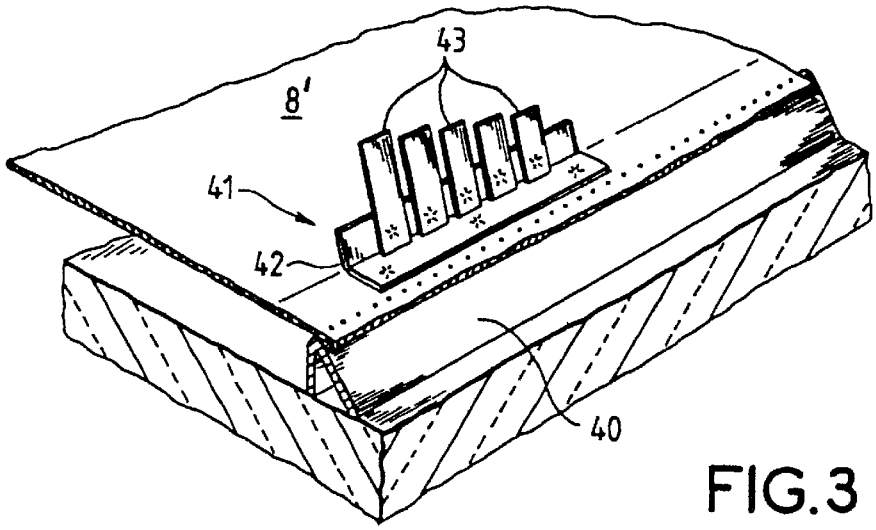
FIG.3 PRIOR ART
FIG. 3 is a perspective view of an embodiment of a vibration damping device according to the state of the art.

As illustrated by FIG. 3, above-cited U.S. Pat. No. 4,827,179 proposes a solution for damping the vibrations of the mask via a device 41 forming a coupled oscillator, by disposing on the edges of the mask 8', in proximity to the zone where the mask is welded to a frame 40, a mechanical structure comprising a rigid support 42 to which is welded at least one flexible reed 43. The natural resonant frequency of the device 41 is chosen in such a way as to damp the vibrations of the mask in a specified frequency band. However, this structure has a number of disadvantages:

- it is complex and expensive owing to the sizeable number of metal components used (support and flexible reeds);
- energy dissipater elements must be appended to the damping structure if it is desired that the vibrations of the mask be damped rapidly.

The present invention proposes a simple, economic and easily implemented structure for damping the vibrations of a mask stretched in one or two directions.

Figure 5:
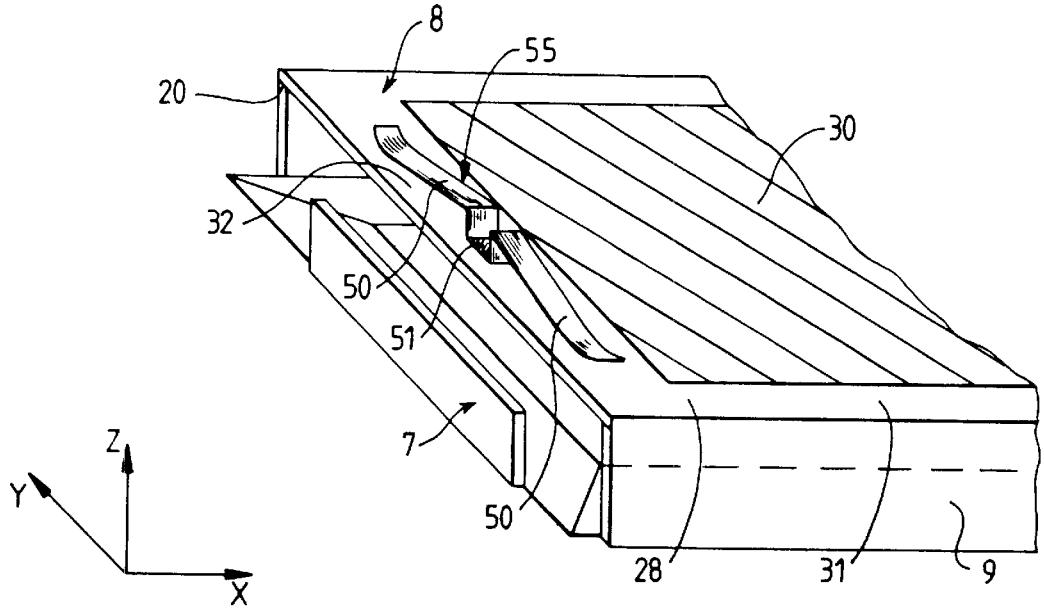
FIGS. 5 to 9 illustrate various embodiments of the invention.

FIG. 5 is a perspective view of a first embodiment of the invention, adapted to a mask stretched in a single direction, for example parallel to its short sides 32.

In the peripheral part 28 of the mask 8, for example along its vertical short sides 32, is disposed a damping device 55 in the form of a strip, metallic for example, comprising a central part 51 secured to the surface of the edge of the mask, for example by welding, and two wings 50 extending on either side of this central part. The damping device 55 can thus be made as a single component by blanking out from a metal strip and stamping or as two identical components connected together in the vicinity of the central part 51. The damping device 55 will form together with the mask a system of coupled oscillators; the parameters of the damping device 55, such as the length of the wings 50, their thickness and their weight, are chosen in a conventional manner so that the natural frequency of vibration of the device 55 is close to a chosen value, for example the natural resonant frequency of the mask in such a way that the vibrations of the damping device 55 will be subtracted from the vibrations of the mask.

Figure 4:
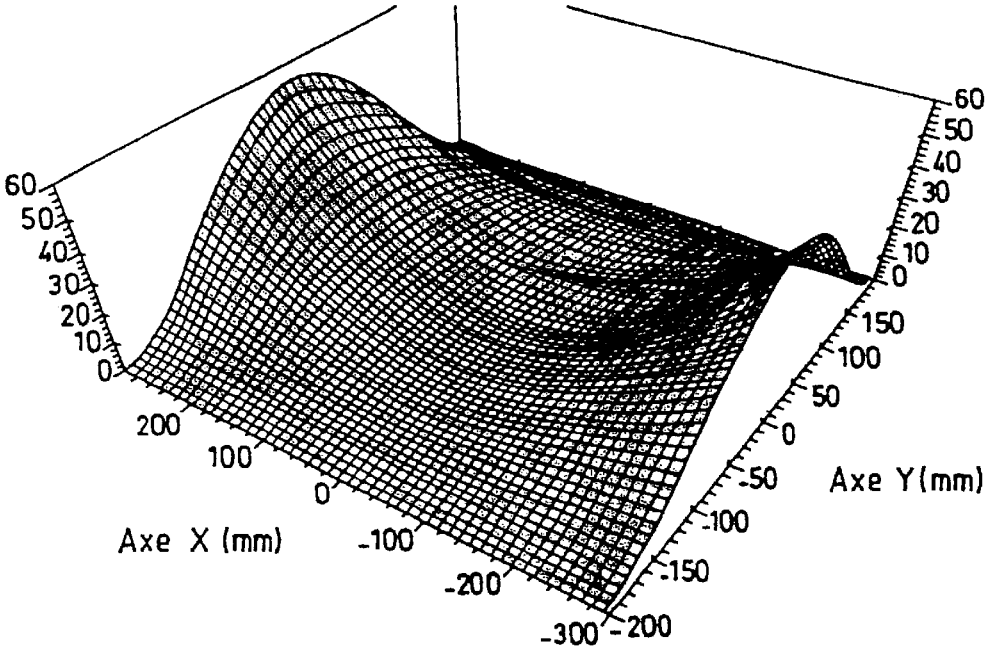
FIG. 4 illustrates the displacement profile of the surface of a stretched mask subjected to vibrations.

When the frame/mask device is such that the mask possesses a part 30 perforated with apertures in columns connected together by metal bridges, that the tension exerted on the mask is uniaxial, in for example the direction of the short sides 32, the long sides being welded to the edges 20 of the long sides 9 of the frame, the behavior of the mask under vibration is in accordance with FIG. 4; the amplitude of vibration of the mask is a maximum in the vicinity of the middle of the short sides 32. For a tube incorporating a mask frame of the type described above, it is therefore advantageous to dispose a damper according to the invention in the middle of each of the two short sides of the mask.

Figure 6:
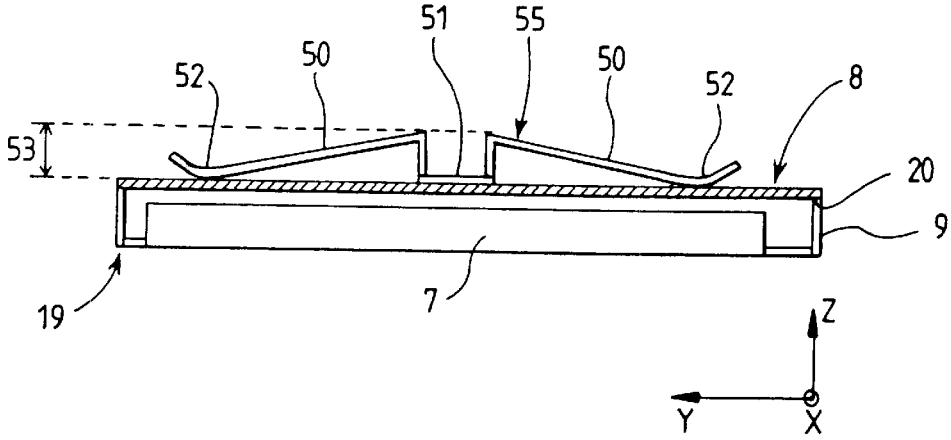

The invention offers a structure allowing simple implementation of means for dissipating the energy communicated to the mask during a shock to the tube or by way of powerful sound waves. Specifically, it is necessary that the vibrations communicated to the mask, even if they are of low amplitude, should not be allowed to last for too long since they then become visible during the operation of the tube. Since the mask is located inside the tube in a very high vacuum, it is necessary to add energy dissipation means so that the mask is rapidly damped. It is for example advantageous for a part 52 of the wing 50 to come into contact with the mask when the latter tends to vibrate. The vibration energy is then dissipated by friction between the parts 52 of the wings of the damper and the surface of the mask, as shown by FIG. 6 illustrating a side view of the frame/mask according to the invention. The winged shape of the device 55 makes it possible to obtain maximum energy dissipation by friction by disposing the parts 52 in such a way as to come into contact with the mask near the zones of low vibration amplitude, for example in the vicinity of the ends of the wings 50; the central part of the damper 55 being disposed in the zone of maximum amplitude of vibration of the mask, the part 52 of the wing will then rub on the mask over a zone of sizeable length, proportional to the height 53 of the wing measured with respect to the plane of the mask.

Figure 8:
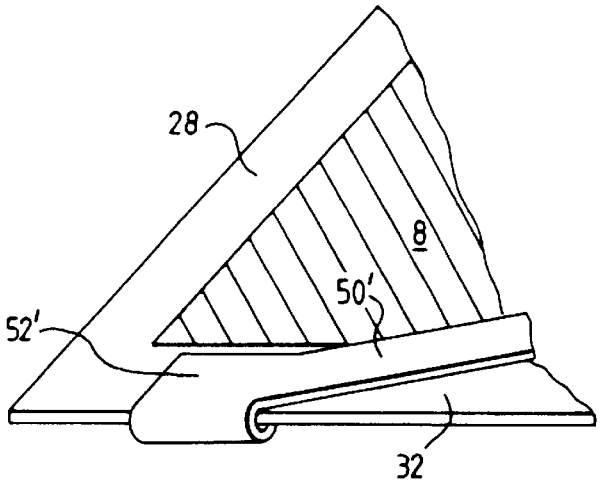

FIG. 8 shows, in a perspective view, the detail of an end of a wing 50' according to another embodiment; this end 52' will sandwich the edge 32 of the mask in such a way as to increase the surface of rubbing between the end 52' and the surface of the mask so as to dissipate the vibration energy of the mask more rapidly.

Figure 7:
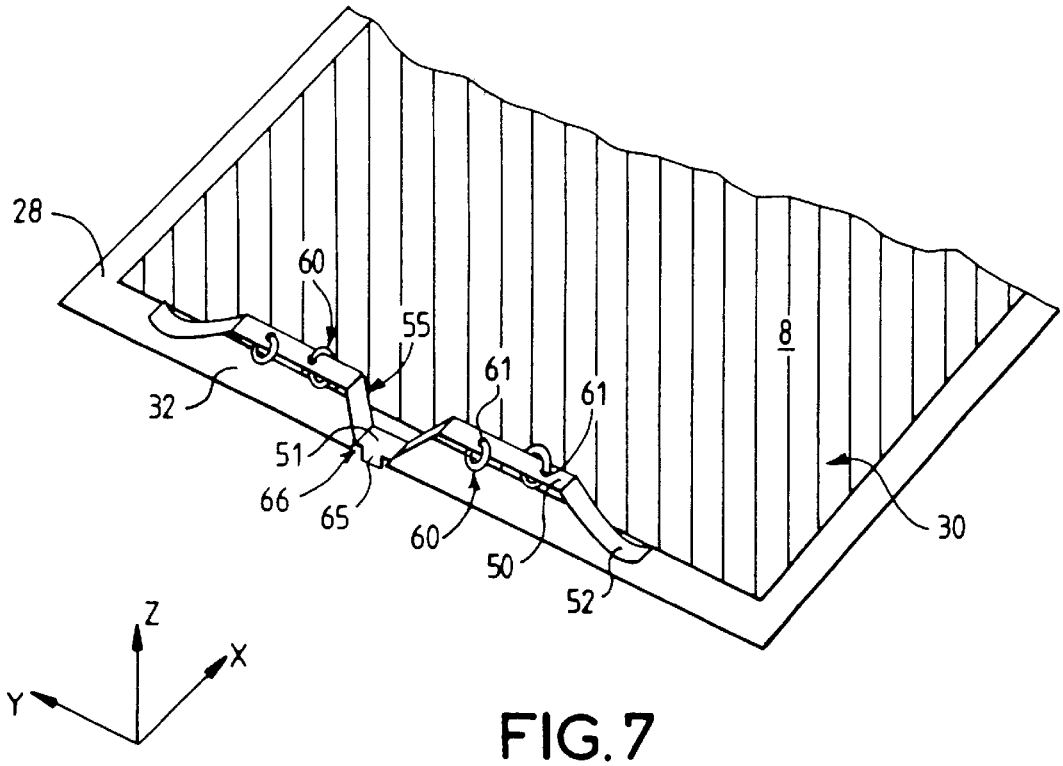

In order to reduce the time of oscillation of the mask 8, it is possible as illustrated by the perspective view of FIG. 7, to append to the wing of a damper 55, at least one metal collar or annulus 60 passing through an orifice 61 made in the wing. The collar can be open or closed, its cross section being slightly smaller than the diameter of the orifice 61 so as to be able to move in this orifice and dissipate the energy by friction on the edge of the said orifice. In another embodiment which is not represented, rivets are disposed in such a way as to pass through the wings 50 through orifices 61 made therein, the heads of the rivets having a greater dimension than that of the orifices whilst the body of the rivet has a smaller cross section than the diameter of the orifice.

The layout of the coupled oscillators along the short sides 32 of the mask is not limiting. For example, in the case where the mask is stretched in two directions parallel to its length and its width, it is advantageous to dispose the vibration dampers according to the invention both along the horizontal and vertical edges of the mask.

Moreover, the damper oscillators according to the invention can be disposed either on the surface of the mask facing the phosphor screen or, conversely, on the surface of the mask on the electron gun side. It may also be advantageous to dispose the dampers on both faces of the mask so as to obtain the desired damping effect.

Figure 9:
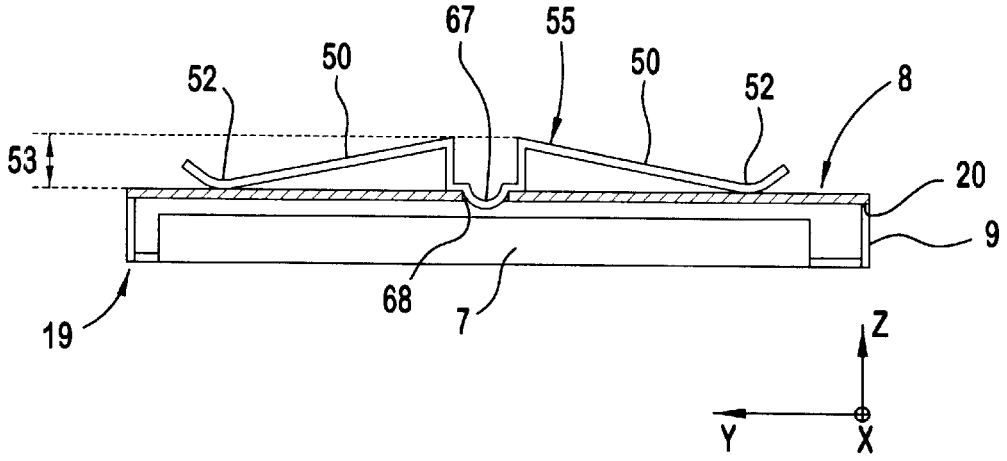

Means for positioning the coupled oscillator on the surface of the mask may be added without any complex modification of the structure of the oscillator or of the mask itself. These means have the objective of facilitating the positioning of the coupled oscillator on the edge of the mask during the tube manufacturing process. As illustrated in FIG. 7, these positioning means can consist of a tab 65 integral with the oscillator 55 cooperating with a notch 66 situated on the edge of the mask 8. Alternatively, the tab can be integral with the mask and the notch situated on the central part 51 of the oscillator 55. As illustrated in FIG. 9, these positioning means can consist of a boss 67 integral with the oscillator 55 cooperating with an aperture 68 situated on the mask 8.

In another embodiment which is not illustrated, the positioning means can consist of a boss intended to be inserted into a suitable aperture; the boss can be disposed either on the mask, and it then cooperates with an aperture disposed on the central part 51 of the oscillator, or on the surface of the oscillator 55, for example on its central part 51, and it then cooperates with an aperture disposed on the edge of the mask 8.

What is claimed is:

1. A color cathode ray tube comprising:

a color selection mask in the form of a substantially rectangular metal foil, adapted so as to be fixed under tension to a support frame and mounted inside the front face of the tube, said mask comprising a central zone drilled with orifices and a peripheral zone disposed between the central zone and the edges of the mask, said mask being able to vibrate independently of the support frame, and means for damping mask vibrations which are disposed at said periphery of the mask so as to damp the vibrations in said mask, the damping means comprising a resonator in the form of a flexible strip of which one part is fixed to a surface of the peripheral zone of the mask with two wings, extending on either side of said one part.

2. The cathode ray tube according to claim 1, wherein the mask is stretched in a single direction and the resonator is fixed to an edge of the mask, the wings of the resonator extending in a direction parallel to the direction of tension of the latter.

3. The cathode ray tube according to claim 1, wherein the resonator further comprises means for dissipating the vibration energy.

4. The cathode ray tube (1) according to claim 1, wherein a part, of the wings of the resonator comes into contact with the surface of the mask at least when the latter starts vibrating again.

5. The cathode ray tube according to claim 4, wherein the part of the wings coming into contact with the surface of the mask extends on either side of the edge of the mask in such a way as to sandwich it.

6. The cathode ray tube according to claim 3, wherein the means for dissipating the energy comprise at least one annulus passing through the thickness of a wing of the resonator.

7. The cathode ray tube according to claim 1, wherein the resonator and the mask comprise additional positioning means cooperating so as to ensure the positioning of the resonator on a surface of the mask.

8. The cathode ray tube according to claim 7, wherein the positioning means comprise a boss cooperating with an aperture.

9. The cathode ray tube according to claim 7, wherein the positioning means comprise a tab cooperatin with a notch.

* * * * *